US009365936B2

(12) United States Patent
de Pierola

(10) Patent No.: US 9,365,936 B2
(45) Date of Patent: Jun. 14, 2016

(54) DETACHABLE RETRIEVABLE OUTBOARD SYSTEM AND APPARATUS FOR SACRIFICIAL ANODES

(71) Applicant: Nicolas de Pierola, Westminster, CA (US)

(72) Inventor: Nicolas de Pierola, Westminster, CA (US)

( * ) Notice: Subject to any disclaimer, the term of this patent is extended or adjusted under 35 U.S.C. 154(b) by 0 days.

(21) Appl. No.: 14/682,353

(22) Filed: Apr. 9, 2015

(65) Prior Publication Data

US 2015/0259807 A1 Sep. 17, 2015

Related U.S. Application Data

(63) Continuation of application No. 14/657,010, filed on Mar. 13, 2015.

(60) Provisional application No. 61/967,334, filed on Mar. 15, 2014.

(51) Int. Cl.

| | |
|---|---|
| ***C23F 13/00*** | (2006.01) |
| ***C23F 13/06*** | (2006.01) |
| ***C23F 13/16*** | (2006.01) |
| ***C23F 13/20*** | (2006.01) |

(52) U.S. Cl.

CPC ..... *C23F 13/005* (2013.01); *C23F 13/06* (2013.01); *C23F 13/16* (2013.01); *C23F 13/20* (2013.01); *C23F 2213/30* (2013.01)

(58) Field of Classification Search

CPC ..... C23F 13/02; C23F 13/06; C23F 13/08; C23F 13/10; C23F 13/16; C23F 13/18; C23F 13/20; C23F 2213/30; C23F 2213/31

USPC ..... 204/196.01, 196.1, 296.17, 296.18, 204/196.19, 196.2, 196.21, 196.33, 196.36, 204/196.37, 196.3–196.31

See application file for complete search history.

(56) References Cited

U.S. PATENT DOCUMENTS

| | | | | |
|---|---|---|---|---|
| 2,863,819 | A * | 12/1958 | Preiser | 204/196.33 |
| 3,010,891 | A | 11/1961 | Anderson | |
| 3,616,421 | A | 10/1971 | Mackintosh | |

(Continued)

FOREIGN PATENT DOCUMENTS

| | | | |
|---|---|---|---|
| EP | 1568599 | A2 | 8/2005 |
| GB | 803863 | A | 11/1958 |

(Continued)

OTHER PUBLICATIONS

PCT/US2016/020400 International Search Report and Written Opinion.

*Primary Examiner* — Luan Van
*Assistant Examiner* — Alexander W Keeling
(74) *Attorney, Agent, or Firm* — Stout, Uxa & Buyan, LLP; Carlos A. Fisher

(57) ABSTRACT

Semi-circuit systems, methods and apparatus for the protection of metallic elements immersed in an electrolytic fluid against electrochemical corrosion. The apparatus preferably comprises four components: a housing component, an anode component, an electrically conductive cord component, and electrical connector component. In preferred handheld examples, the housing component is positively buoyant, featuring impact and water resistant materials, partially encapsulating the anode, thereby protecting nearby structures from impact damage, while shielding the anode component from sunlight, thereby reducing the rate of marine growth thereon.

29 Claims, 8 Drawing Sheets

(56) References Cited

U.S. PATENT DOCUMENTS

| | | | | |
|---|---|---|---|---|
| 4,080,272 | A | 3/1978 | Ferry et al. | |
| 4,549,949 | A | 10/1985 | Guinn | |
| 5,298,794 | A | 3/1994 | Kuragaki | |
| 5,627,414 | A | 5/1997 | Brown et al. | |
| 5,643,424 | A | 7/1997 | Riffe et al. | |
| 6,183,625 | B1 | 2/2001 | Staerzl | |
| 6,209,472 | B1 | 4/2001 | Staerzl | |
| 7,064,459 | B1 | 6/2006 | Staerzl | |
| 7,131,877 | B1 * | 11/2006 | Staerzl | 440/76 |
| 7,264,697 | B2 | 9/2007 | Ali et al. | |
| 7,635,237 | B2 | 12/2009 | Spears et al. | |
| 7,764,187 | B2 | 7/2010 | Gai et al. | |
| 8,118,983 | B1 | 2/2012 | Anderson et al. | |
| 8,317,996 | B2 | 11/2012 | Nelvig et al. | |
| 2007/0029191 | A1 | 2/2007 | Sewell | |
| 2013/0093351 | A1 * | 4/2013 | Chiu | 315/291 |

FOREIGN PATENT DOCUMENTS

| | | | | |
|---|---|---|---|---|
| GB | 809006 | A | 2/1959 | |
| GB | 813569 | * | 7/1959 | B63B 22/00 |
| JP | 2005329828 | A | 12/2005 | |
| KR | 20040008782 | A | 1/2004 | |
| KR | 20070050626 | A | 5/2007 | |
| WO | 2007013826 | A1 | 2/2007 | |
| WO | 2013175155 | A1 | 11/2013 | |

* cited by examiner

DETACHABLE RETRIEVABLE OUTBOARD SYSTEM AND APPARATUS FOR SACRIFICIAL ANODES

SPECIFIC REFERENCE TO RELATED PATENT APPLICATIONS

This patent application claims priority to Non-Provisional patent application Ser. No. 14/657,010, filed Mar. 13, 2015, which claimed priority of Provisional Patent Application Ser. No. 61/967,334, filed Mar. 15, 2014, each of which is hereby expressly and entirely incorporated herein by reference.

FIELD OF INVENTION

The present invention concerns the prevention of electrochemical (defined herein as galvanic and/or electrolytic) corrosion to metallic structures in fluid electrolyte environments, which may cause damage and expenses to marine structures totaling in the billions of dollars worldwide. Thus, the invention relates to industries including the boating and marine engineering industries, and offshore and onshore engineering enterprises, such as offshore oil drilling platforms, bridges, piers, and the like.

BACKGROUND AND SUMMARY

Galvanic corrosion is a spontaneous electrochemical process in which one metal corrodes preferentially to another when both metals are in electrical contact, in the presence of an electrolyte. This same galvanic reaction is exploited in primary batteries to generate an electrical voltage. The galvanic circuit is an electrochemical process that generates electrical energy as a result of redox (reduction and oxidation) reactions between e.g., different metals or alloys connected by an electrolyte while in surface to surface contact with each other. It occurs when a number of factors take place in conjunction: there have to be different first and second metals; the first and second metals must be in electrical contact; and both the first and second metal must be in the presence of an electrolyte, such as salt water. The most noble of the two metals becomes the cathode, and the less noble (more "active") metal becomes the anode, and subject to becoming oxidized, and corrosion.

In this application it will be understood that, unless specifically indicated otherwise expressly or by context, the word "metal" or "metals" is meant to include both the pure elemental metals such as Fe, Mg, Au and Cu, as well as metal alloys, such as steels, bronzes, brasses and the like, which may comprise two or more elements or metals. It will be understood herein that the words "noble" and "active" are used in a relative sense in this application unless specifically indicated otherwise. Thus, a metal is more noble than another metal (or alloy) if it is more resistant to corrosion than the other metal. Standard galvanic series of metals are easily available, and provide a listing of different metals and alloys in order (or in reverse order) of their nobility.

As an example, one such listing of a galvanic series is provided herein in the order from more noble to less noble: graphite; gold; platinum; titanium; nickel iron chromium alloy 825; alloy stainless steel; stainless steel-grades 316 & 317; nickel copper alloys—400, k500; stainless steel-grades 302, 304, 321 & 347; silver, nickel 200; nickel chromium alloy 600, nickel aluminum bronze; 70/30 copper nickel; lead; stainless steel-grade 430; 80/20 copper; 90/10 copper nickel, nickel silver; stainless steel-grades 410, 416, silicon bronze; manganese, admiralty brass; aluminum brass; 50/50 lead tin solder; copper; tin; naval brass; yellow brass; red brass; aluminum bronze; austenitic cast iron; low alloy steel; mild steel; cast iron; cadmium; aluminum alloys; beryllium; zinc; magnesium.

Dissimilar metals and alloys have different electrode potentials, and when two or more come into contact in an electrolyte, one metal acts as anode and the other as cathode. The electro potential difference between the dissimilar metals is the driving force for an accelerated attack on the anode member of the galvanic couple. The oxidation of the anode alters its molecular structure, corroding it gradually to the point at which the anode losses structural strength and may become totally disintegrated, gradually dissolving into the electrolyte if the process is permitted to continue unhindered.

Most floating vessels and other marine structures comprise underwater components made of two or more dissimilar metals which may be placed in direct and/or electrical contact with each other, like a bronze propeller attached to a stainless steel shaft, for example, in stern drive or outboard motor-driven vessels. When immersed in an electrolyte, such as sea water, the lesser noble metal, will thus be subject to galvanic corrosion. Over a period of time, this process can deteriorate such metallic underwater parts, thereby potentially causing catastrophic mechanical failures. Such failures may include, for example, the failure of metal parts of the steering system if the rudder, its hinges, pintle (pivot pin) or the gudgeon (fitting for the pintle) is damaged, or of the propulsion system if the propeller's blades edges are corroded. Indeed such galvanic corrosion may even endanger the water-tight integrity of a boat by damage of through-hull fittings, like the engine's cooling system water intakes, or waste water outlets, which can, in extreme cases, lead to valuable property loss and even the chance of human casualties.

Electrolytic corrosion is a non-spontaneous electrochemical reaction, which may occur when stray current finds a path comprising, for example, a vessel's shaft and propeller, such as for instance, from the vessel's direct current (DC) battery bank through a "ground fault"; such as if a positive DC wire comes in contact with bilge water, or surfaces moistened by spray or sea breeze. Alternate current (AC) leaks from, for example, shore power sources may also contribute to this usually aggressive and often unpredicted electrolytic corrosion, sometimes referred to as "electrolysis", which could result in metal parts being structurally weakened or damaged beyond repair as quickly as in a matter of weeks. Even when a submerged metallic element cast of an alloy such as bronze is not in direct physical contact with any other metallic part, this electrolytic corrosion will still corrode the more active (less noble) element of this alloy; depending on the type of bronze used, the alloy could contain up to 10% of aluminum or zinc (or in the case of a brass part, up to 33% zinc), and if the corroded metal happens to be a through-hull fitting, this could lead to the vessel sinking, with tragic consequences. There are documented cases of vessels sinking by electrochemical corrosion damage with human fatalities included, so the prevention of this problem in floating vessels is not only relevant, as most boat owners believe, based on potential financial losses, but may have a human toll as well.

Commonly, galvanic and electrolytic corrosion is prevented and/or controlled in the marine industry by integrating sacrificial anodes into the natural galvanic circuit, so expensive metallic submerged components are protected by becoming the cathodes, rather than the anodes, in the circuit. Sacrificial anodes are often streamlined-shaped cast lumps of low nobility (highly active) metals in the galvanic series, such as zinc, aluminum and magnesium. Systems into which sacrificial anodes may be incorporated include the following:

Direct Contact Systems

Such systems function by simply attaching one or more sacrificial anodes so that their surfaces directly touch the surfaces of the metal(s) designed to be protected, e.g., by bolting or welding. Direct contact systems are mostly used by steel hull vessels, such as vessels in the fishing industry, commercial cruisers, and some military vessels; this can be expensive because it requires the vessel to be hauled out of the water. In the case of (mostly) smaller, fiberglass, aluminum or wooden-hulled craft, for example, pleasure craft yachts, divers may install and regularly replace, as necessary, specially designed anodes that are fastened directly over parts like shafts, rudders, struts.

Bonding Circuit Systems

A similar but more sophisticated method to control unwanted galvanic and electrolytic corrosion is the implementation of a "bonding system", electrically linking metallic components together in a single protective circuit. For example, such a system may comprise a highly conductive, low resistance (such as 8 or 6 American wire gauge (AWG)) copper wire which is welded to inboard portions of all the submerged metallic parts of a vessel, like through-hull fittings, struts, shafts, rudders, etc. The bonding system may run between these metallic parts in a loop, or may link one or more such parts through individual wires from the part(s) to a bus bar; that is, a common connection point for the metals to be protected to be connected to the bonding circuit. Such a bonding circuit tends to equalize the redox potentials of the different metallic components, which collectively become the cathode. Both ends of this wire circuit can then be joined to a sacrificial anode, more active than any of the metals of the cathode. The bus bar can thus provide a convenient common attachment point for connected parts to the sacrificial anode via a wire or other conductive connection.

For example, the wire can meet at two threaded rods that go through the hull and hold a fastened sacrificial anode (usually cast of zinc) on the exterior of the vessel under the water line, providing cathodic protection to all metals connected to this bonding semi circuit system. The term "semi circuit" is sometimes used herein to describe the bonding circuit, since the bonding circuit only becomes a full circuit when the vessel is immersed in, and the bonded metallic components are exposed to, an electrolytic fluid medium.

Many modern yachts are built with an integrated bonding circuit system, but again, a boat owner/skipper often only visually inspects the condition of the underwater components of his yacht by himself every other year at most, when he has the boat hauled our of the water. Thus, the owner or skipper usually hires a diver to inspect the boat on a monthly basis and replace the anodes generally whenever this diver considers it convenient.

Hiring a diver is not only an expensive service, but more alarmingly, does not guarantee that the submerged metallic components will be free of electrochemical corrosion. For example, factors including: fraying of wires by vibration and/or heat from the engine; direct contact of the bonding wires with salt water from the bilge; and other short circuits can break or otherwise defeat the bonding circuit. Additionally, other scenarios include the diver's failure to adequately clean the metallic surfaces (for example, stainless steel shafts, or trim tabs) between anode replacements that need to be in clean electrical contact. Such surfaces may sometimes develop an almost imperceptible non-conductive crust of oxidation (such as chromium oxide), by chemical reaction with the oxygen in the water. Another cause of loss of conductivity may be caused by the growth of algae, barnacles, coral tubes (also known as worm tubes); and/or other marine organisms, causing "bio-fouling" which creates resistance to electron flow. Indeed, a simple failure to maintain an electrically tight fit to the fasteners that hold the anode in place, might break the circuit and leave all submerged metallic components vulnerable to electrochemical corrosion.

Hanging Anodes

A type of sacrificial anode (termed a "hanging anode"; sold under the name "Grouper Zinc", "Mermaid Zinc" and the like, comprises a lump of a galvanic active metal, such as a zinc or magnesium alloy (often cast in the shape of a fish) with a single wire embedded in it, and may comprise an alligator clamp or terminal ring at the opposite end of the cable.

This hanging anode permits a boat owner or operator to connect the alligator clamp or terminal ring directly to whatever metallic component of the vessel he wants to protect, or if the vessel has a bonding system, directly to one of the circuit's bolts on the inside of the vessel, so the owners/operators can monitor how the anode is working by themselves, and without the intervention of a diver, just by pulling the anode out of the water.

However, the hanging anode has not enjoyed widespread acceptance by the boating or marine engineering community for a variety or reasons. Firstly, the hanging anode assembly is often quite unsightly. Often within days after a hanging anode is placed in the water, algae can start growing over the wire connector, and soon will grow over the actual anode. This may soon be followed by mussels and barnacles, creating an unsightly system that is progressively less effective with time. One cannot use an anti-fouling paint coat to coat the anode, since it would reduce or block electrical conductivity between the anode and the electrolyte solution.

Furthermore, the hanging anode may damage the gel coat, deck, topsides, or hull of the boat due to impact, or friction, or gradual wear due to a "pendulum effect" of the heavy, rough metallic anode rubbing against a pristinely buffed gel coat hull, varnished teak surfaces, or painted areas, or when, for example, the hanging anode is removed from the water. Indeed, just the rocking motion of the sea when handling this anode (which could sandwich the hanging anode between the dock or a fender and the boat), may cause damage.

Additionally, the electrical connection between the alligator clip or similar fastener and whatever point in the bonding system it might be attached to, may often provide a rather subpar, weak and unstable electrical contact rather than a firm and secure, point of contact with optimal conductivity.

International Patent Publication No. WO 2007013826 describes a housing for sacrificial anodes for the use of borne vessels in which the anode is always attached to the vessel. In this system, a compartment built into the hull of the vessel is accessible from within the interior of the vessel for changing and monitoring the sacrificial anode; when the watertight access hatch is closed, the anode is directly exposed to the water on the outside of the boat.

British Patent Application No. GB 803,863 describes a system to prolong the life of a sacrificial anode assembly comprising a perforated ion current-limiting assembly surrounding the anode and limiting the current flow from the anode to the cathode. The anode is directly bolted to the cathode; between the anode and cathode is a layer of insulation prevents contact except via the bolts.

British Patent Application No. GB 809,006 describes a system drawn to cathodic protection of ferrous metal in or constituting a tank in a tanker ship. The anode is protected by an insulating cage and is suspended from an insulated, current carrying cable connectable to a source of electric current through a vented shaft-like pipe extending through the top of the tank into the ballast water therein.

U.S. Pat. No. 7,635,237 is drawn to an anode column for protecting a marine structure such as an offshore oil rig from corrosion comprising an elongated guide an elongated conductive anode carrier surrounding the guide and designed to be affixed to a seabed in an upright orientation, at least one sacrificial anode carried by the anode carrier, and an electrical conductor extending from the column and adapted to be connectable to the marine structure.

Without any limitation of the scope of the present invention intended or made, there is clearly a need for preferably portable, preferably handheld, systems that permit the facile installation, monitoring and replacement of sacrificial anodes by the owner or operator of a marine structure (e.g., a boat, dock, or platform). Such systems may ideally obviate the need to place, inspect, replace and service the anodes by diving, at dry dock, or to necessarily apply an auxiliary electrical current as on expensive impressed current cathodic protection systems. Even in cases where traditional sacrificial anode systems are used, the parallel use of such a system would result in lower cost through less frequent replacement of the anodes, and reduced divers' labor charges, while working as an ideal back up in case of a primary system failure.

There is also a need for improved electrochemical corrosion prevention systems in which an anode is contained within a housing that provides a cushion between the anode metal and surrounding marine structure(s), thus protecting such structures from damage resulting from contact with the anode metal. Unlike bare anodes that are simply dangled into the water by a cable with an alligator clip, such a system may utilize an anode which is largely surrounded by a housing that may be pliable, elastic, inflatable and/or which otherwise buffers the marine structure from the metal anode.

There is further a need for improved electrochemical corrosion prevention systems employing sacrificial anodes whereby the anode is preferably contained in a housing that can be treated with an anti-fouling coating, such as anti-fouling paint, to avoid marine growth. This can be particularly advantageous when the housing is positively buoyant in water and is visible in a harbor or marina; the lack of unsightly marine growth provides cosmetic advantages not capable of being provided otherwise.

Additionally, there is a need for portable systems that comprise means for providing a solid, stable electrical contact between metal parts and an anode that can be readily connected (and disconnected) as a quick and easy temporary emergency solution; for example, to protect metal parts against damage from sudden rogue stray current corrosion scenarios in the time frame before diagnosis of the source of the problem and/or necessary repairs are performed by a marine electrician. Furthermore, such systems are particularly advantageous in dangerous conditions that involve, for example, low visibility murky waters caused by extreme weather conditions like heavy rain or strong currents, or in hazardous polluted waters, where having a diver perform inspections and/or take care of anode installations is unfeasible.

Each and every publication, patent and published patent application cited in this patent application is hereby individually incorporated by reference in its entirety as part of this patent application.

SUMMARY

The present invention is drawn to detached outboard housings for marine anodes, systems comprising such housings, methods of protecting submerged or partly submerged metallic marine structures from electrochemical corrosion, and systems for easily and effectively electrically linking an anode to a marine structure to be protected from electrochemical corrosion.

Thus, in certain examples, the present invention is directed to a system and apparatus comprising a semi circuit which generally may comprise:

"A": an impact-friendly housing component designed and structured to hold a metallic anode and assume and maintain an upright orientation in an electrolytic fluid medium. The housing component preferably provides facile accessibility for inspection and handling, and enables an electrical conductivity path between the sacrificial anode and the metallic parts to be protected.

"B": a metallic sacrificial anode component, easily attached to and removed from the housing component, which is electrically connected to a bonding system when secured in the housing component and which, in certain examples, may have an identifiable shape for mating with the housing component, to assume the electrochemical corrosion.

"C": an elongated electrically conductive component, preferably an electrical cord (having one or more wire), for connecting the anode to the bonding system, and "D": an electric terminal/connector component, such as for example, sockets, plugs, ring terminals, heat shrink tubing, and/or basic direct soldering or welding connections; located on or in a vessel or marine structure. Such electrical connectors securely make solid electrical contact between the cord component and the vessel's bonding system, for example, via a bus bar, rod terminals; or any electrically conductive component of a marine structure that comprises and conductively links to one or more submerged metallic elements to be protected from corrosion, namely the cathodes of the circuit.

In preferred examples, the body of the housing component comprises a buoyant material (such as a low density closed polyurethane foam, a polystyrene foam, or other foamed polymeric materials), or air or gas compartments, in order to permit the housing component to have a positive or neutral buoyancy in water when the anode component is joined thereto.

The housing component is preferably structured to maintain a substantially upright orientation in water, particularly when the anode component is attached thereto. This can be accomplished by various design features: the housing component can be structured to be elongated in a vertical orientation (such as, without limitation, in an approximately conical or pyramidal shape), structuring the location at which the anode component is affixed at or near the lower portion of the housing component, and by locating buoyant material at or near the upper portion of the housing component.

The housing component may be of any shape but, when joined to an anode component, should preferably allow the apparatus to retain a substantially upright, vertical position when floating, when partly submerged, or when totally submerged, and even when dry stored. As indicated previously, the consistent orientation of the housing component may be maintained by placing the buoyant material at or near the end of the housing component intended to be the upper portion thereof, with the anode to be affixed towards the bottom portion of the housing component, so that its weight can also help properly orient the housing component in a liquid-fluid environment.

Furthermore, the shape of the housing component preferably may assist the apparatus in remaining in a fixed position when placed horizontally (i.e., on its side) on a flat surface, for the purposes of inspection, maintenance and/or anode replacements. To accomplish this the base and/or sides of the housing component may be fabricated to comprise one or more flat surface that permits the housing component to be stably set on its side without rolling. For example, the currently preferred embodiment design has a four sided pedestal base which may be aligned with a flat handle when the housing component rests on its side; thus preventing the apparatus from rolling when placed on its side, for example on a boat at sea.

The exterior surface of the housing component, preferably comprises an outer surface made of a waterproof, material. The outer surface is also preferably hydrolysis-tolerant, impact resistant, and durable. The material (or combination of more than one material), may comprise an elastomeric polymer, a synthetic or natural rubber or similar suitable material.

The housing component preferably comprises a core which may comprise a buoyant and/or shock absorbing material, such as closed cell polyethylene or polyurethane foam, or expanded polystyrene plastic (sold under the trademark STYROFOAM®) or another low density material, and/or comprise one or more inflatable fluid compartment encapsulated in the interior thereof to provide desired buoyancy.

Those of ordinary skill in the art will also appreciate that buoyancy may be provided to the housing component the interior of the housing component may comprise one or more hollow compartments that can be filled with air, another gas, water, or another fluid having a specific gravity less than that of the water or other electrolytic fluid into which the housing component is to be immersed. Thus, the housing component need not necessarily have positive buoyancy, but may have neutral or even negative buoyancy; in some examples the buoyancy of the housing component may be adjusted, for example, by increasing or decreasing the amount of fluid contained in the inflatable fluid compartment(s). In use, the housing component may be partly or totally immersed in the electrolytic fluid or arranged to have neutral buoyancy at a particular depth.

Regardless of the shape of the housing component or that of the anode component, it is very preferable that the housing comprises a receptacle cavity formed in a lower end thereof within which an anode may be securely fastened. Such a space serves multiple purposes; in addition to retaining the anode, it may wholly (except for holes or vents permitting the electrolytic fluid to contact the anode) or partially surround and enclose the anode. In preferred embodiments the receptacle cavity is surrounded on at least three sides by the housing component material.

This configuration of the anode within the housing thus allows the anode to maintain contact with the electrolyte fluid when the housing component is placed therein, while preventing it from causing damage by impacting or rubbing against the surfaces of surrounding structures; also shadowing it from direct sunlight to significantly reduce photosynthesis, minimizing algae and other biological growths.

The receptacle cavity preferably has a shape that will closely fit and mate with the sacrificial anode's shape. This snug fit inhibits movement of the anode component relative to the housing component and permits the anode component to make and maintain good contact with the electrolyte fluid when the apparatus floats or is wholly or partly submerged.

As previously indicated, the housing component is structured to maintain an upright orientation when placed in a fluid electrolyte medium with the sacrificial anode attached thereto. Thus, in certain preferred examples, the housing component may float with positive buoyancy on the surface of the fluid medium, or "hover" with neural buoyancy wholly or partly submerged therein, with the anode exposed to the fluid medium on the bottom portion of the housing.

In preferred examples, the portion of the apparatus that is designed to be in direct contact with water is substantially coated with anti-fouling paint to reduce to a minimum the growth of marine organisms and improve the aesthetic appeal of the apparatus.

Identifying indicia, such as luminescent markings, may additionally or alternatively be placed in the area at the exterior of the perimeter of the housing component above the water line to ensure the apparatus remains visible in the absence of daylight. For example, luminescent markings may include a phosphorescent ingredient, such as, without limitation, a polycrystalline inorganic zinc sulfide pigment, that absorbs light energy in the day and is able to give off lower energy and different colored light at night. Such a pigment may, for instance, be mixed with the material(s) of which the housing component is comprised when the housing component is cast, may be applied as part of an outer layer of the housing, or can be easily applied to the outer surface of the housing component, e.g., when mixed with paint. Night identification of the apparatus of the invention may also be achieved, among other ways, by using reflectors, (for example, similar to the ones used in bicycles) applied to or embedded in the topside skin of the housing.

In preferred examples, a handle is featured at the upper end of the housing component so that the apparatus may be easily retrieved, e.g., by hand or by means of a hook. This handle may comprise an internal piece of hard material, such as a metal or a hard polymer (e.g., a polyethylene or polypropylene plastic) to provide extra strength and durability under an outer layer of softer synthetic rubber polymer on the surface of the housing. The housing can be made to be affixable to a detachable length of rope or cord for the purpose of tying the apparatus to a secure structure, such as a cleat on a dock, or to the structure to be protected, as well as for secure dry storage. Use of the handle and the rope encourages the user to avoid using (and damaging) the electrically conductive cord component alone as a means for hauling the housing component. In particularly preferred examples, the handle is incorporated as a unitary piece with the housing component. Although not a necessary element of the invention in other examples, it is a very useful feature and may be necessary in certain examples.

In certain examples the housing component may be structured to provide negative or neutral buoyancy of the housing component with the anode attached, resulting in the housing component being wholly or partially submerged. In some of these examples the inflatable fluid compartment(s) of the housing component may be wholly or partially inflated with a fluid such as air, another gas, water, and/or another fluid having a specific gravity less than that of the water or other electrolytic fluid into which the housing component is to be immersed, to conveniently increase or decrease its buoyancy while continuing to maintain a specific upright orientation. Those of ordinary skill in the art will recognize that such inflatable fluid compartments also provide the housing component with a pneumatic and/or hydraulic resiliency and impact resistance that assist the housing component in preventing damage to the marine structure, such as a vessel's deck, cabin, or the topsides of a vessel's hull.

The interior of the housing component comprises one or more electrically conductive contacts (such as wires or rods) structured to provide an electrically competent coupling with the anode component when it is affixed to the housing component, and to provide an electric current path to the electrically conductive cord component. It will be understood that while the examples of the invention described in this specification generally utilize at least two such contacts (ie., rods or wires) to form a conductive link between anode and bonding system, in less preferred examples, a single wire, and/or rod may be used. In preferred examples, the electrically conductive contacts comprise a plurality of metal rods which protrude into the anode receptacle cavity; these rods preferably have a diameter that permits them to extend through spatially corresponding holes in the anode component. Furthermore, the rods are preferably threaded so as to permit them to be firmly secured to the anode component using nuts and washers. In a preferred example, two threaded rods located at the lower end of the housing component, project along approximately vertical axes of the housing component. The rods may be made of a suitable metal such as stainless steel or bronze (e.g., a silicone bronze). Stainless steel is stronger and harder than bronze, but may be prone to develop pitting corrosion under hypoxic or anoxic water conditions, while silicone bronze has a content of about 90% copper and has superior conductivity, but may be damaged if the nuts are not perfectly aligned when tightened due to its softness.

Preferably, the rods will have a "captive" style design in cross-section, so that they are not round in cross section along their entire length. Very preferably the cross section of the rods comprises angles (for example, like the exterior perimeter of a nut) so that the rods can fit into matching angled cavities, for example, in a backing plate within the interior of the housing component. This is to prevent the following scenario: if a nut that holds an anode in place gets stuck to a standard threaded rod, such that when a person tries to unfasten it, this nut stays in place relative to the rod, but the rod itself begins rotating around its own axis. If this unwanted torque bond (e.g., a "cold weld") between the nut holding the anode and the standard rod is stronger than the tightness between the nuts fixing this rod in place and the backing plate or whatever else was anchoring the rod in place within the housing component), the rotation of the rod may result in the wire connecting the bonding system to the anode component becoming detached or broken, with the result that the electrical continuity is lost and the galvanic cycle is interrupted, with total loss of cathodic protection.

Very preferably, the housing component comprises one or more backing plates, which give structural strength to the housing while simultaneously allowing certain degree of flexibility, to help maintain waterproof integrity. The backing plates may be made of high-density polyethylene or another polymer having similar strength and hardness (e.g., polypropylene), but could as well be made of other materials such as, for example, fiberglass and/or wood. The backing plates preferably having smoothed, rounded edges. Backing plates are preferably mounted using a waterproof, space-filling cement, such as marine adhesive caulk sealant to maintain the waterproof nature of the interior of the apparatus, thus minimizing the possibility of a short circuit. In other examples, glues, plastic welding and various other means of mounting the backing plates in a waterproof fashion may be used.

In a currently preferred set of examples, two backing plates are mounted in the housing. In these examples, a first backing plate is positioned at the interior top surface of the receptacle cavity. This first backing plate comprises holes corresponding to the conductive rod(s) permitting the rod(s) to protrude therethrough. A second backing plate is structured to be mounted on the lower surface of an interior cavity within the housing component. In some examples, this second backing plate is thicker than the first backing plate, and the rods are securely joined to the second backing plate. In some examples the ends of the rods are threaded and protrude through corresponding apertures in the second backing plate. The rods are affixed to the second backing plate by any suitable method, such as by firmly securing with nuts or by imbedding the rods within the backing plate itself. As indicated above, preferably the rods have a cross-section other than circular, and the corresponding apertures in the backing plate(s) are also preferably formed with the same cross sectional shape with a slightly larger size.

In a preferred example, the rods are connected (e.g., soldered, welded, or joined through terminal rings) to wires that emerge from the electrically conductive cord component. The airtight chamber protecting the internal electrical connections of the housing component may be formed by then covering these connection points with a watertight semi-hemispherical airtight shell, and epoxy glued the shell to the thick backing plate, to constitute a airtight chamber.

Thus, in this example, the resulting assembly may comprise a "sandwich like" horizontal arrangement of two hard backing plates, said arrangement tightly secured to both an interior surface contained within the body of the housing component and an exterior parallel surface of the receptacle cavity portion of the housing component, with a waterproof cement, such as a marine adhesive caulk sealant compressed between them. The anode component, contained with the receptacle cavity, may then be fastened to the threaded rods using nuts and washers as spacers so that water can flow around the back of the anode; more washers and nuts retain the anode firmly within the receptacle cavity.

Waterproof integrity of the internal area for the electrical connections to be made is an important feature of particular examples of the invention. As mentioned above, a sealant may comprise, for example, the watertight polyurethane marine adhesive sealant known as 3M™ Fast Cure Adhesive Sealant 5200, manufactured by the 3M Company (or a more flexible polysulfide sealant such as 3M™ 101 Polysulfide Marine Sealant) may be used as a gasket; the sealant not only seats and cements the backing plates to the housing component body, but may preferably be used to form a waterproof seal between the washers and nuts on both sides of the backing plates.

In preferred examples, the electrically conductive cord component exits the waterproof interior of the housing at a connection point at or near the upper portion of the apparatus. This connection point may preferably be waterproofed by using a compression seal fitting structured to allow the conductive cord component to exit the body of the housing without permitting moisture to enter the interior of the housing body or the waterproof chamber within. An additional precaution for ensuring a waterproof seal at this point, which is generally especially subject to stress by the tension of the cable against the housing), may to use a guard or shield to prevent flexing of the electrically conductive cord component during use. This may involve fabrication of, for example, a tube or inverted funnel-shaped polymer piece integrated into the housing body, the handle, or both, which may join the electrically conductive cord component and the housing component.

The size and weight of the housing component (including the sacrificial anode) will generally depend on factors including the size of the marine structure to be protected, the underwater surface area of the metal parts to be protected, and the like; these parameters can be scaled to the size of the structure intended to be protected. As just one example, for boats around 12.2 meters, (40 feet) in length, the apparatus may be, for example, about 40.64 cm. (16 inches) high, by about 30.48 cm. (1 foot) at its widest point, with an anode of roughly 20.32 cm. diameter by 2.54 cm. thick, (8 inch diameter by 1 inch thick), weighing about 6 pounds with the anode component included, but excluding the electrically conductive cord component.

In a preferred example, a sacrificial anode component may comprise a magnesium, aluminum or zinc metal. In marine environments the anode component is generally made from zinc or a zinc alloy. However, as is known by those of ordinary skill in the art, an anode may comprise any material, or combination of materials, more galvanically "active" (less noble) than the material it is used to protect.

The design or shape of the anode component(s) of the present invention may be any shape or size suitable to the task. Thus, the housing component (for example, the receptacle cavity portion of the housing component) may be designed and structured to host any desired anode shape available in the market, or may be specially made to fit an anode component of a tailored shape.

It will be clear that, while the presently preferred examples of the claimed apparatus is designed with a housing component structured to host sacrificial anodes, with minor modifications the present invention could easily be adapted for use in conjunction with an "impressed current" cathodic protection system, which utilizes non-sacrificial anodes. Such anodes may include materials including titanium, graphite, and high silicon cast iron, among other metals. Impressed current systems are well known to the person of ordinary skill in the art.

The shape of the housing component and that of the anode component should be matched so that the anode can be securely affixed to the housing component in a manner providing good electrical connection and a stable mechanical connection. A tested prototype design uses 10.16 cm. by 15.24 cm. (4 inch by 6 inch) plates of zinc.

In preferred examples, the anode component may be structured to have a substantially flat, disc-like shape without sharp edges, thus minimizing the risk of stress or scratching against surrounding materials in case of frictional or compression contact. The preferred anode components are designed to fit the recess of the matching receptacle cavity shape of the housing component, although the anode component might, for example, retain the same perimeter outline while having a thicker, "shallow cylinder" type of profile. The anode component preferably comprises one or more holes, through which fasteners may be extended to retain the anode component within the receptacle cavity; one or more such fasteners are very preferably electrically conductive. In especially preferred examples the fasteners comprise rods held in place with nuts and washers having the same or similar galvanic potential; preferably made from the same material.

In other examples, the surface ratio between the anode and the cathode may be increased to manage certain degree of passivation of the anode by balancing the goal of protecting the metallic components while structuring the anode component to corrode at a slower pace and thus last longer. This goal can be reached, for example, without increasing the mass or weight of the anode component, by shaping the anode component as a hollow, approximately tubular-shaped component; this provides a large surface area for the electrolytic fluid to be in contact the anode component. Similar results may be obtained by increasing the number, and decreasing the size, of holes made in the anode component.

The "cord" portion of the electrically conductive cord component may preferably be similar in composition to the standard grade electrical cord used for marine "shore power" or heavy-duty extension cord applications. For example, the cord may comprise AWG individually tinned, copper strand wires, may have high performance insulated nylon sleeves, and be stabilized to ultraviolet light exposure and corrosion-resistant. Preferably, the electrically conductive cord component has watertight molded plug and connector ends.

In certain examples the electrically conductive cord component is an innovative invention in and of itself, and in conjunction with the system and apparatus described herein. The cord component is preferably strong, flexible, and durable under heavy use, while maintaining the ability to effectively conduct a galvanic current under all foreseeable weather conditions. Additionally, in order to prevent inadvertent electrical shock, it is quite important that the cord not be used as a traditional AC or DC extension cord, as this could result in injury or death. Thus, in preferred examples, the cord is structured to minimize this hazard by structuring the electrical connectors of the cord component and those comprised in the structure to be protected (e.g., male and female elements; socket and plug, and the like) to be incapable of connection to standardly used AC or DC fixtures. That is, the electrical connectors are very preferably not capable of forming an electrically conductive connection with any of the United States Department of Commerce International Trade Administration (ITA) plug/socket Types A-O. Collectively, these plug and socket types shall be referred to herein as "standard AC or DC" fixtures or connections.

To this end, very preferably the electrically conductive cord component comprises a design, different from that of a standard AC or DC plug or socket, of protruding male prongs to matching female sockets. This design is preferably different from the placement of electrical connections in standard AC or DC connections of any country or region, in order to prevent the danger of electrical shock. In some designs male plugs or prongs and female sockets or recepticles may be present in the same cord component. These and similar designs, variations of which will be immediately apparent to the person of ordinary skill in the art, will be advantageously used to reduce or eliminate the risk of human error in connecting the bonding system of the structure to be protected, or the housing component, to AC or DC electrical sources of any kind. Very preferably, the design ensures that the electrical connectors of the present apparatus not only fail to match electrical connectors authorized for use in the United States or Europe, but also fail to match authorized electrical connectors in non-US, non-European countries as well.

Indeed, in certain examples the electrically conductive cord component of the present invention may include a special color or pattern design (or both) on the cord casing and/or structure connectors as an extra security feature.

Thus, in a preferred embodiment, a unique plug and socket pattern, such as (without limitation) a "happy face" plug and socket design combination described in greater detail below, is used for all the electrical connectors of the invention.

The electrically conductive cord component may be segmented (i.e., having internal electrical connectors for extension purposes) at different points and in different ways without altering its functionality principle: as long as there is conductive continuity and optimal low resistance. Preferably, the conductivity capacity of the housing component and the cord component matches or exceeds that of the bonding circuit of the structure to be protected.

Is worth mentioning that as a security feature to avoid tension tending to pull, for example, electrical connectors apart, the electrically conductive cord component attached to the vessel from its connection, any intermediate extender cord segments, and/or the cord component attached to the apparatus may comprise loops, rivets or other "holdfast" structures (for example, on the cord insulation) that can be fastened to the dock and/or to the vessel or structure to be protected and thereby absorb any pulling forces from the opposite end, tending to separate the cords for each other (when a segmented cord), or from the structure's electrical connector component, while in use. Those of ordinary skill will recognize that additional or alternative securing means, such as locking connectors (e.g., twist-lock connectors) may be used to prevent mating electrical connectors from becoming detached from each other.

In order to provide an electrical connection between the electrically conductive cord component, the electrical connections securing the cord component to the anode within the housing component, and/or the electrical connections securing the cord component to the structure to be protected, any suitable means can be used. Some examples have been described above with respect to the electrically conductive cord component. Further illustrations of examples falling within the scope of the present invention are described below.

In certain examples, the electrically conductive cord component may be structured to be embedded within the housing component, emerging therefrom and terminating in, for example, a molded male plug. This male plug is structured to form an electrically competant connection with a matching female plug on a proximal end of a second cord component. The second cord component may then terminate on its distal end in, for example, two ring terminals, each structured to fit over and fasten to two standard threaded rod terminals of a boat's bonding system; the ring terminals may be secured using, for example, nuts, sor a combination of nuts and washers. These ring terminals are preferably made of copper, but can be any appropriate conductive material.

This semi-permanent "rings-to-rods" single cord connection arrangement could also aid for easy temporary storage of the apparatus aboard the structure to be protected. For example, in combination with an inboard storage compartment aboard a vessel, when the boat or other vessel is to be used, the apparatus could just be pulled out of the water and stored in this compartment.

In other examples, the housing component is structured with an embedded male plug with protruding prongs located on or near the upper portion of the housing (for example, at the foremost upper part of the handle), to which the electrically conductive cord component may be connected, using a female plug with complimentary matching slots or holes. At the distal end of the cord component a male plug can be connected to a matching female socket in the structure to be protected; this female socket is electrically linked to the structure's bonding system, for example, using ring terminals, as described above. It is advantageous in this example that the connector in the housing component is a male connector to ensure that water will not enter the housing component, as might be the case if the housing component's electrical connector were a female connector. This coupling point is preferably reinforced by a "screw ring" fitting, commonly used in marine power cords in the market.

In other examples, the housing component comprises an embedded male plug, similar to the previous example. In this example, the electrically conductive cord component may comprise a "plug" type electrical connector at one end, while at the distal end of the electrically conductive cord component two ring terminals may be fastened to, for example, the threaded rods of a boat's bonding circuit system. In this example, the cord component is semi-permanently fixed to the structure to be protected, and the housing component is the removable component of the circuit.

In some examples, the electrically conductive cord component may remain more or less permanently connected to both the structure and to the housing component, through a non-spliced, single piece cord component having no molded electrical "plug-type" connectors. For example, when the structure to be protected is a vessel, the housing component (with anode attached) is semi-permanently attached to the electrically conductive cord component, and may simply be hauled out of the water and stored on board when the vessel is about to be operated. This configuration may be ideal for a disposable, "single anode cycle life" apparatus falling within the scope of the present invention, and/or to allow versatility of connection for example in emergency situations in which a socket is not in place or cannot be conveniently installed.

In view of the present disclosure, a person of ordinary skill in the art will easily envision various other alternative methods of attaching/connecting the distal end of the cord component to the structure to be protected.

It will immediately be apparent to one of ordinary skill in the art that any suitable number of cord-to-connectors links may be used so long as any increased resistance in the circuit resulting from, e.g., cord component length or disparate wiring materials does not unduly hinder the flow of electrons in the circuit.

With respect to the desired characteristics of the linkage ("plug and/or socket"-type connectors), as previously mentioned, for safety reasons a socket, if present, should be designed and structured to make it substantially impossible for any other kind of electrical power (AC or DC) pattern design to match. Additionally, the socket should preferably be designed to keep moisture out, such as by using a screw cap, a "snap-close" lid with rubber gaskets, and/or a screw assembly that allows unit exchange accessibility.

In other examples, the invention may concern methods for preventing corrosion to one or more metal-containing objects wholly or partly immersed in an electrolytic fluid, comprising the steps of conductively joining the object(s) to an apparatus comprising a sacrificial anode component, a housing component and an electrically conductive cord component, all of which are defined as described above.

In other examples, the invention may comprise a system for preventing corrosion to one or more metal-containing objects wholly or partly immersed in an electrolytic fluid, comprising conductively joining an apparatus comprising:

a sacrificial anode component, a housing component and an electrically conductive cord component, to said one or more metal-containing object(s) immersed in an electrolytic fluid.

In other examples, the invention is drawn to an apparatus comprising a housing component, as described above.

In other examples, the invention is drawn to an apparatus comprising a housing component, as described above, joined to an anode component.

In other examples, the invention is drawn to a housing component conductively joined to an electrically conductive cord component.

In other examples, the invention is drawn to an electrically conductive cord component, as described above.

In other examples, the invention is drawn to a structure comprising:

one or more metal-containing objects which are, or which are subject to becoming, wholly or partly immersed in an electrolytic fluid;

an electrically conductive bonding system linking said one or more metal-containing objects to an electrical connector, said electrical connector comprising a plug and/or a socket, affixed to said structure;

wherein said electrical connector comprises an arrangement of protrusions and/or invaginations different from that of incapable of forming an electrically conductive connection with a plug or socket of a standard AC or DC fixture.

To the extent that a plurality of inventions are disclosed herein, any such invention shall be understood to have disclosed herein alone, in combination with other features or inventions disclosed herein, or lacking any feature or features not explicitly disclosed as essential for that invention. For example, the inventions described in this specification can be practiced within elements of, or in combination with, other any features, elements, methods or structures described herein. Additionally, features illustrated herein as being present in a particular example are intended, in other aspects of the present invention, to be explicitly lacking from the invention, or combinable with features described elsewhere in this patent application, in a manner not otherwise illustrated in this patent application or present in that particular example. The scope of the invention shall be determined solely by the language of the claims. All publications, patents and patent documents cited herein are each hereby incorporated by reference in its entirety for all purposes to the same extent as if each were so individually denoted.

These and other aspects and advantages of the present invention are disclosed in the following detailed description and claims.

DETAILED DESCRIPTION OF THE INVENTION

The present invention concerns systems, methods, and apparatus for employing an anode (such as a sacrificial anode), to protect metallic structures in a fluid electrolytic environment, from electrochemical corrosion. In other examples, the present invention includes systems and methods for electrically linking a vessel's galvanic bonding system circuit to a detached outboard anode housing component, via an external portable semi-circuit comprised of specific connectors and cord components linking the vessel to be protected and this anode, such as by the use of "plug and socket" type electrical connectors.

The various descriptions of the invention provided herein illustrate presently preferred examples of the invention; however, it will be understood that the invention is not limited to the examples provided, or to the specific configurations, shapes, and relation of elements unless the claims specifically indicate otherwise. Based upon the present disclosure a person of ordinary skill in the art will immediately conceive, and be placed in possession, of other alternatives to the specific examples given, such that the present disclosure will be deemed to have provide a full written description of each of such alternatives as if each had been specifically described as well.

EXAMPLES

Example 1

Figure 1:
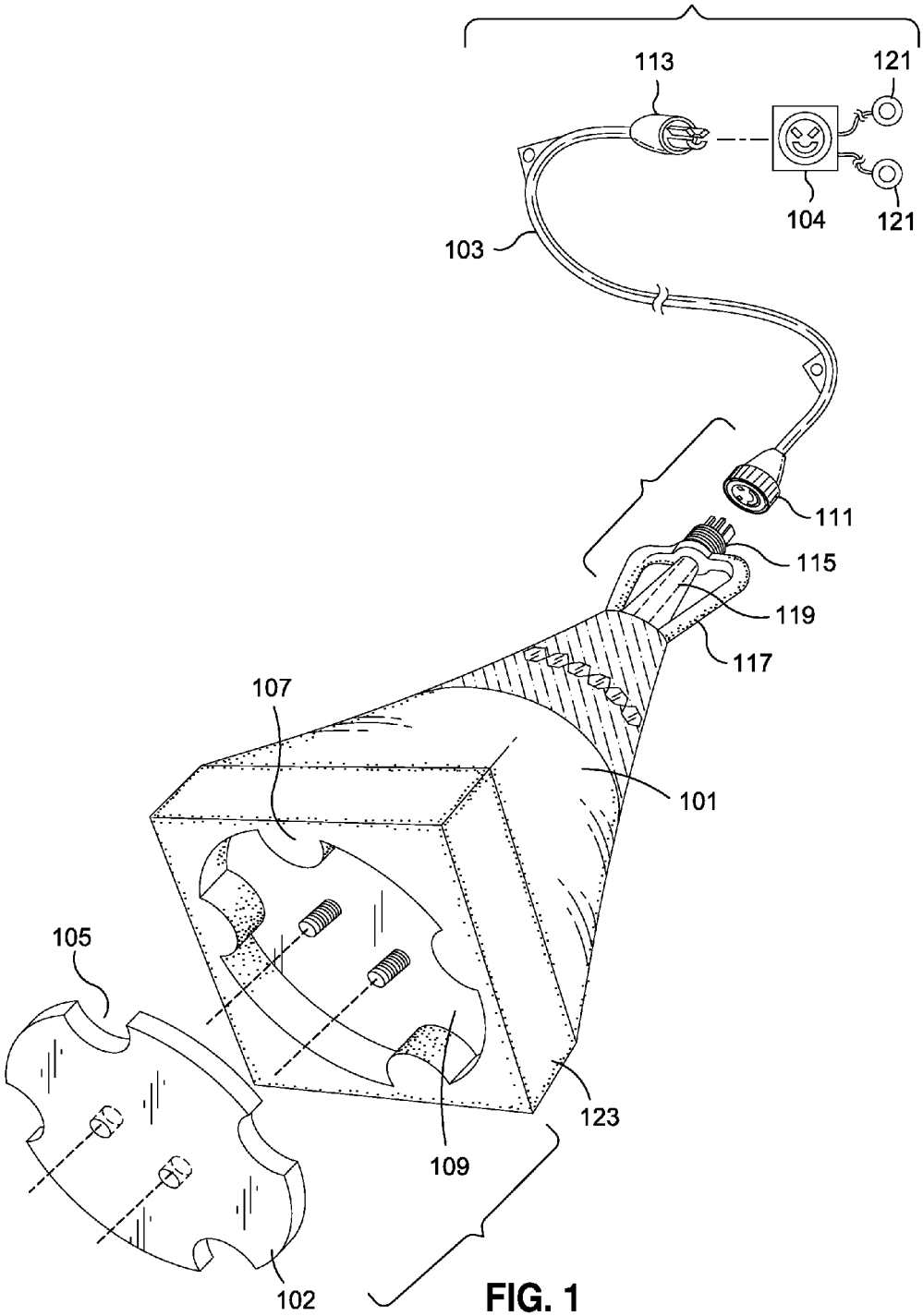
FIG. 1 depicts an example of the apparatus of the present invention, showing an exploded view of an assembly comprising a housing component, anode component, cable component, and a socket component of the structural bonding system.

FIG. 1 depicts an embodiment of one example of the present invention. This figures shows a generally conically-shaped housing component 101, a generally disc-shaped anode component 102 having 4 roughly hemispherical rounded notches 105 symmetrically positioned at approximately 90 degrees to each other around the circumference of the anode component. It will be appreciated that these notches, and corresponding hemispherical projections 107 within the receptacle cavity 109 of the housing component permit the anode component to be securely positioned within the receptacle cavity securely without movement. Additionally, the shape of the anode component (including, for example, the presence, absence, and shape of any projections or notches) and of the receptacle chamber (including, for example, the presence, absence, and shape of any projections or notches) can be tailored as desired.

As shown, the housing component comprises a rectangular base 123, which permits the housing component to lie horizontally on a flat surface without rolling. The housing component exterior preferably comprises an impact friendly elastomeric natural or synthetic polymer material, such as polyethylene.

An electrically conductive cord component 103 is shown in FIG. 1, with a female socket connector 111 at the proximal end of the cord component and a male plug connector 113 at the distal end thereof. The female connector 111 is structured to matingly connect with a male connector 115 affixed to a handle 117 comprising the top, distal, end of the housing component. An inverted funnel shaped reinforcement 119 encircles and protects the cord component within the interior, "hand-grip" portion of the handle.

As shown in FIG. 1, the bonding system (not shown) of the structure comprising metal-containing parts to be protected also comprises a female connector 104 which is, in turn structured to be connected to the bonding system by a pair of terminal rings 121.

This system may be used as follows: the anode component 102, is fastened to the housing component 101, and so an electrical connection is there established between the anode component and the attached cord component 103. Preferably, the distal end of the cord component comprises an electrical connector, such as for example, a plug 113, or a pair of ring terminals; see FIG. 3, 301; permitting the cord component to make a stable, sturdy electrical link with the structure's bonding system via a complementary connector component located at the structure intended to be protected, shown in FIG. 1 as a socket 104. Any other suitable means may be employed to make an electrical connection with the bonding system of the structure to be protected; for example the connector component may comprise a pair of threaded rods terminals electrically linked to the metallic components of the submerged structure to be protected, for example, through a vessel's bonding circuit, as depicted in FIG. 2, 212.

In use, the housing component can simply be immersed in the water next to the vessel (or other structure) to be protected, where the electrolytes in the liquid fluid (such as fresh water or seawater) will close the galvanic circuit between the anode and the metal-containing elements of the bonding circuit, such as the propellers, shafts, rudders, fittings, and any other submerged metallic components that are electrically bonded between each other and electrically linked to the housing component and sacrificial anode, thus ensuring that such elements become cathodes in the system and are protected against electrochemical corrosion.

It should be understood that the housing component, the anode component, the electrically conductive cord component and the electrical connectors of the bonding system do not necessarily need to be independent or separated from each other, but might very well be incorporated into each other in any suitable combination of two or more components. For example, and without limitation, the cord component may be incorporated as part of the housing component as a molded, integrated non-detachable piece; the anode component may be joined (for example, embedded or molded) to the housing component as a single piece disposable unit; or one or more connector component might be also made non-detachable, for example, as two ring terminals soldered at the end of the cord component. The cord component may be semi-permanently fastened to the rod terminals of a structure's bonding system; or the 'connection component' may be made permanent and inconspicuous by direct soldering.

Moreover, each one of the four components may be divided into subcomponents. For example, without limitation, one housing component may contain more than one anode components; one cord component may be sub-divided into two or more segments joined by connector components. Likewise the connector component may be composed of not just one, but two or more parts; and/or the housing component may comprise detachable replaceable parts.

Certain non-limiting examples of such integrations, fragmentations, and combinations thereof are described in the examples of this specification; a person of ordinary skill in the art would recognize that many more variations and subcombinations of the examples may be made. All such variations and subcombinations are intended to be with the descriptive scope of this specification; the invention is thus only limited by the claims.

Example 2

Figures 2A, 2B:
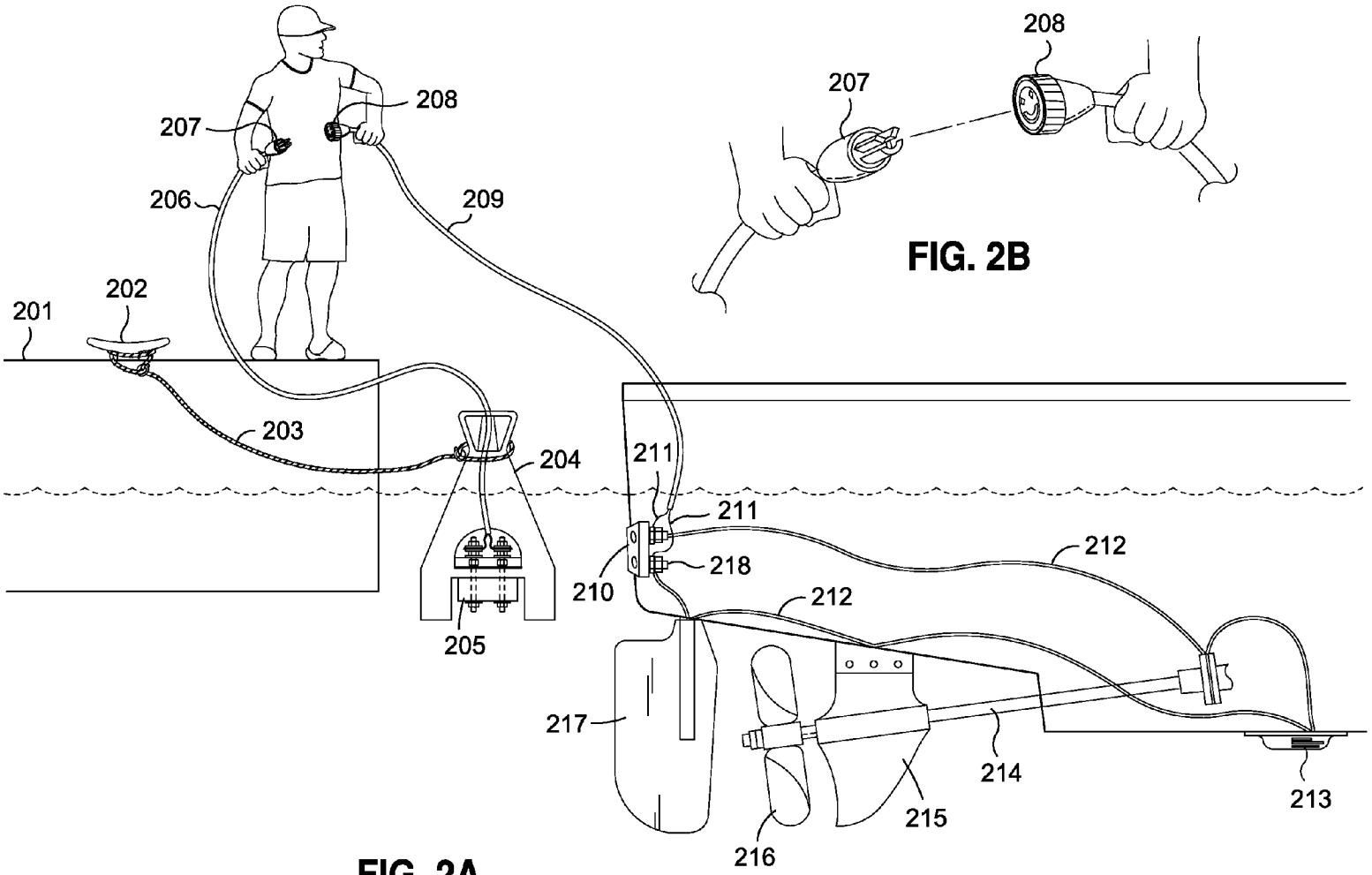
FIG. 2A shows an exemplary system and apparatus of the present invention, in which an anode component, supported by a housing component, is electrically coupled to a bonding system of a boat.
FIG. 2B depicts a view of exemplary male and female electrical connectors of the present invention.

FIG. 2A shows an example of the anti-corrosion system of the present invention, and its components, in use. In this example, the structure to be protected is a boat; the metal-containing parts subject to risk of galvanic corrosion in this figure are: a through-hull screen 213 a propeller shaft 214, a strut 215 and propeller 216, and a rudder 217. These metal-containing parts are electrically joined within the hull of the boat by bonding circuit wiring 212. In this example, the bonding circuit is exactly that: a circular arrangement of electrical connections joined at threaded rods comprised as part of the vessel's bonding system terminal 218. Those of skill in the art will recognize that an undetected break or short in this circuit could result in risk of corrosion for all the metal-containing parts. Thus, alternative bonding circuits may be envisioned, and include connections via feeder wires from each of two or more metal containing parts directly to a bus bar. The bus bar would thus be a central point of electrical connection, with the result that a short of one of the feeder wires, while exposing the metal-containing part joined thereto to risk of corrosion, would not jeopardize the other parts connected to the bus bar. The bus bar may itself comprise the vessel's bonding system terminal 218, or may be an ancillary terminal connected thereto. The cable component from the housing component/anode may thus be connected to the bus bar, to the bonding system terminal, or to any other element of the bonding system wiring.

Returning to FIG. 2A, the vessel's bonding system terminals (one of which is shown as 218) are connected directly to a first segment of the cord component 209 via wires from the apparatus 211 secured to the rods of the bonding system terminal. Also connected to the bonding circuit terminals an optional sacrificial anode in the vessel is also shown 210.

The first cord component segment 209 is connected to a second cord component segment 206 (leading to the housing component 204) via connector components 207 and 208. FIG. 2B shows a detailed view of the connector components of FIG. 2A, comprising a male plug connector 207 joined to the second cord component 206, and a female socket connector 208 joined to the first cord component 209.

The housing component 204 is shown in cross-sectional view with an anode component 205 secured on rods within a receptacle chamber of the housing component. The view shows the airtight chamber within the body of the housing component, with the proximal end to the second cord component 206 having terminal rings secured to the same rods as the anode component.

Finally, the housing component and anode assembly are shown with an optional detachable rope or line 203 secured around the top of the housing component and tied to a cleat 202 of a nearby dock 201.

Figure 3:
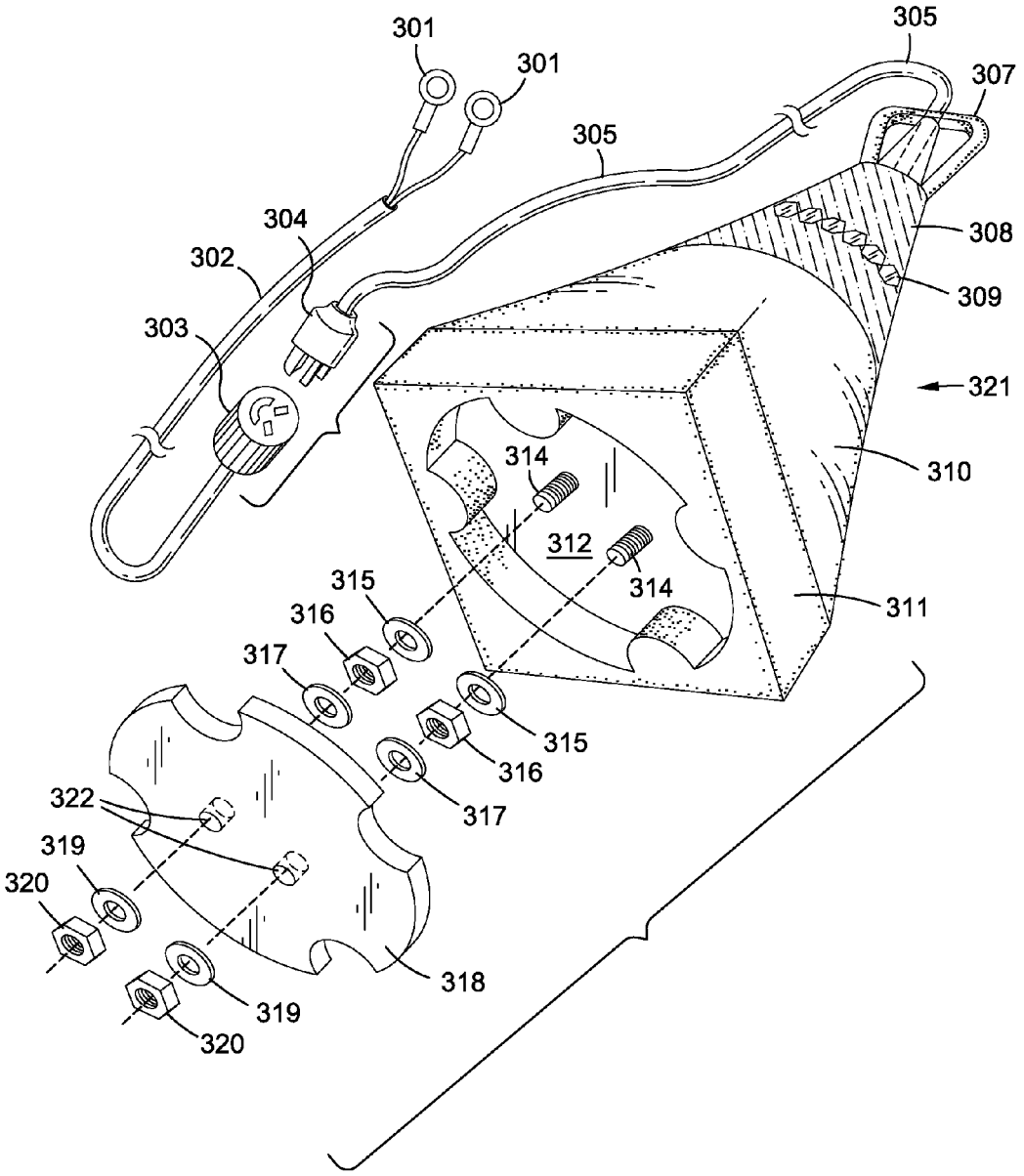
FIG. 3 is an exploded view of an exemplary housing component and anode placement of the present invention apparatus and the anode with a segmented cord component featuring complementary matching plug connectors and ring terminal connectors.

FIG. 3 shows a detailed expanded view of the housing component, anode component, and first and second cord components shown in FIG. 2A. The first cord component segment 302 ends in terminal ring electrical connectors 301 at the distal end, and a socket connector 303 at the proximal end. Second cord component segment 305 is structured to mate with socket connector 303 and terminates in a plug electrical connector 304 at its distal end. The proximal end of the second cord component segment 305 ends in terminal rings (not shown) which are secured to the distal end of the threaded rods 314 within the airtight chamber of the body of the housing component (not shown).

As shown in this example, the second cord component segment 305 projects through an aperture in the handle 307 of the housing component 321. The cord component segment then enters the body of the housing component, terminating within the airtight chamber (not shown). The exterior of the housing component 321 comprises optional regions of phosphorescent paint or coating 308 and light reflective prisms 309; the portions of the housing component expected to be most exposed to water are also treated with anti-fouling paint 310. The base of the housing component is a rectangular cube 311, to aid in stability of the apparatus when lying horizontally on a deck, dock, or other surface.

The anode component 318 is conductively fastened to the housing component by using a set of spacing washers 315, 317 and nuts 316. In this example of the present invention, preferably the spacing washers and nuts are arranged to prevent the anode component from sitting flush against the receptacle cavity wall 312 of the housing component 321. The anode component is then secured through holes 322 upon threaded rods 314 and washers 319 and nuts 320 threaded and tightened to securely hold the anode component firmly and conductively to the housing component.

It will be understood that FIG. 3 shows one preferred example of a portable handheld detached retrievable outboard housing system and apparatus for sacrificial anodes. In this example the upper portion of the housing component 321 has a shape substantially similar to that of a cone integrated in a single piece with a lower portion comprising a shallow cuboid pedestal 311. Preferably, the cone portion and pedestal portion of this housing component are both cast of a single piece of impact resistant, waterproof elastomeric polymer, such as a rubber.

The conical shape depicted provides the housing component with the ability to maintain a constant upright configuration in any flat solid surface even when no anode component is attached. In a liquid fluid, with obvious fluctuations, this conical shape, owing to its buoyant top and denser material's bottom, will mostly maintain, regain, constant upright configuration, but to a noticeable higher degree when the heavy anode component is attached, so it can be inferred at a glance when/if the housing has little or no anode mass left. Those of ordinary skill in the art will appreciate that other shapes may also achieve the same "amphibious vertical axis stability". As just one example, a pyramidal shape with an anode fitting into a receptacle in the base would react similarly in solid and liquid environments.

Figures 4A, 4B:
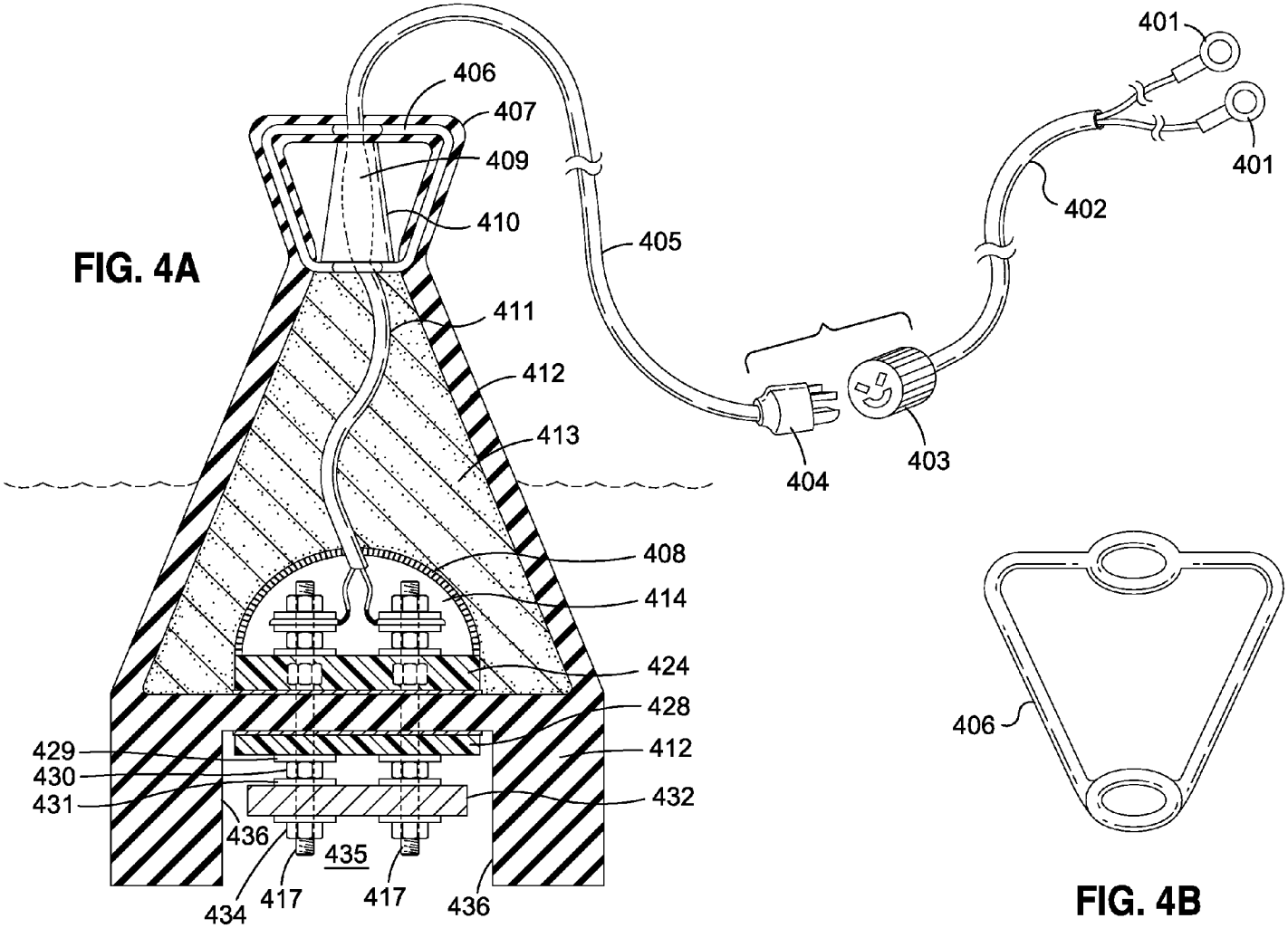
FIG. 4A is a cross-sectional view of an exemplary apparatus of the present invention.
FIG. 4B is a view of one example of an internal reinforcement component of the handle of the apparatus.
Figure 4D:
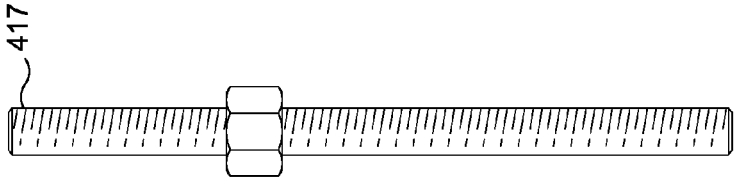
FIG. 4D is a view of a captive threaded rod showing the characteristic angled portion thereof.
Figure 4C:
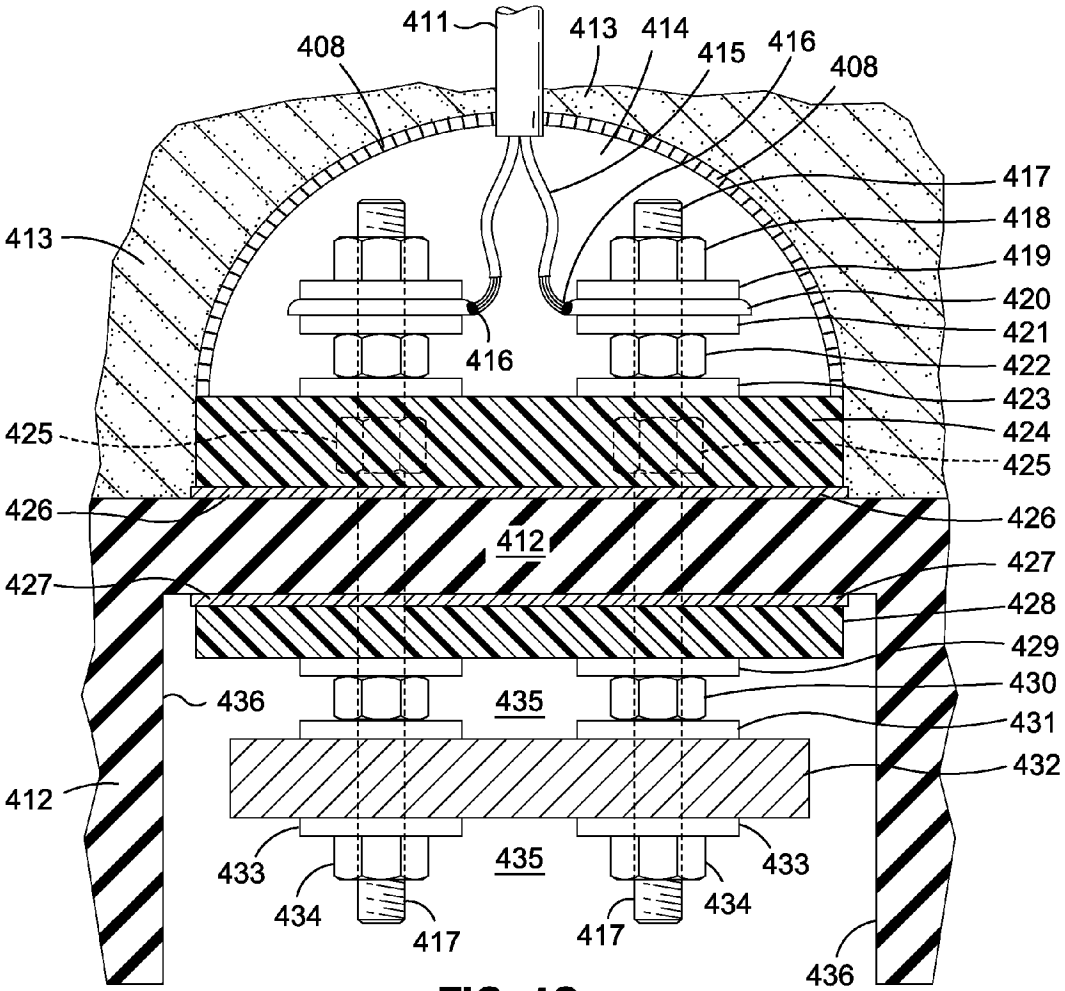
FIG. 4C is a close-up cross-sectional enlarged view of the electrical connections within an airtight chamber of the housing component of FIG. 4A.

FIG. 4A is a cross-sectional, unexploded view, and FIG. 4C a magnified view of the electrical connections, of the same apparatus example depicted in FIG. 3, showing how the anode component 432, may be fastened to the threaded rods 417, for example using spacer nuts 430, and spacer washers 429 and 431, so that water can flow around the front and back of the anode 432, within the perimeter walls 436 with locking washers 433 and nuts 434 to retain the anode firmly in place within the receptacle cavity 435 against a non-conductive backing plate 428. The anode component comprises holes (see FIG. 3, 322) through which the two electrically conductive threaded rods 417 are placed. The threaded rods protrude upwards into the internal part of the housing component, reaching the thick backing plate 424 (like the thin backing plate, also non-conductive), where they are secured against unwanted axis rotation by a captive cavity 425, within the thick backing plate. The captive cavity 425 or angled hole matches the upward angles of the rods 417 (depicted in (FIG. 4D), and is fastened with nuts 422 and washers 421 and 423 in a sandwich configuration, with the elastomeric body of the housing component 412 tightly compressed between both backing plates and sealed with marine grade caulk (426 and 427), between each backing plate and the rubber body to ensure the interior of the housing component and the airtight chamber 414 is waterproof, as well as to provide structural strength to the entire housing), as depicted in (FIG. 4C).

After the threaded rods are fastened at the top of the thick backing plate 424 with a first set of nuts and washers (422, 423 and 421, respectively), a second set of nuts and washers (418 and 419, respectively) will be fastened in sequence, to sandwich a pair of ring terminal connectors 420, one at each threaded rod between these sets of fasteners. These ring terminal connectors 420, which may comprise disk cone spring washers (e.g., "Belleville washers"), are intended in this example of the invention to ensure that the original torque pressure imparted between the hardware components during the manufacture process will remain unhindered. The ring terminal connectors 420 are connected through soldered points of contact 416 to mechanically spliced copper threads of the jacketed wires 415 that emerge from the proximal end of a cord component 411.

All these components are encapsulated in an airtight chamber 414 sealed by a polymer hemispherical casing 408 epoxy-glued to the top of the thick backing plate 424. The internal portion of the electrically conductive cord component 411 now penetrates upward through the top of the polymer hemispherical shell into the foam core of the housing component 413, extending upward in a "s" shape trajectory to help deflect excessive pulling tension on the electrical connections. The cord component segment 405 then emerges from an opening in the housing component (not shown), sealed to be watertight, at the lowest point of the handle 407 of the housing component. As shown in this example, the second cord component segment 405 is structured to comprise a thickened region 409 to prevent slippage of the cord through the upper hole of the handle. Additionally, the cord component is preferably enclosed in an inverted funnel shaped reinforcement 410, for example, a polymer epoxy glued reinforcement structured to work in tandem with the thickened region of the second cord component segment to prevent the cord from possibly being able to slide up and through the top of the handle if subject to forceful pulling tension. The second cord component segment 411 then exits the body of the apparatus through an opening, at or near the top of the handle 407. In FIG. 4A, ring terminals 401, cord component segment 402, socket connector 403, and plug connector 404 correspond, respectively, to reference numerals 301, 302, 303 and 304 of FIG. 3.

This handle is preferably formed using a specially designed piece of hard polymer, such as polyethylene plastic (see FIG. 4B, 406) which will be the core of the handle, to provide extra strength and durability to the external synthetic rubber polymer covering 407. The cord component 411, may go through a ring in the middle of the grasping portion of the handle 406, shown in FIG. 4B.

Figure 5:
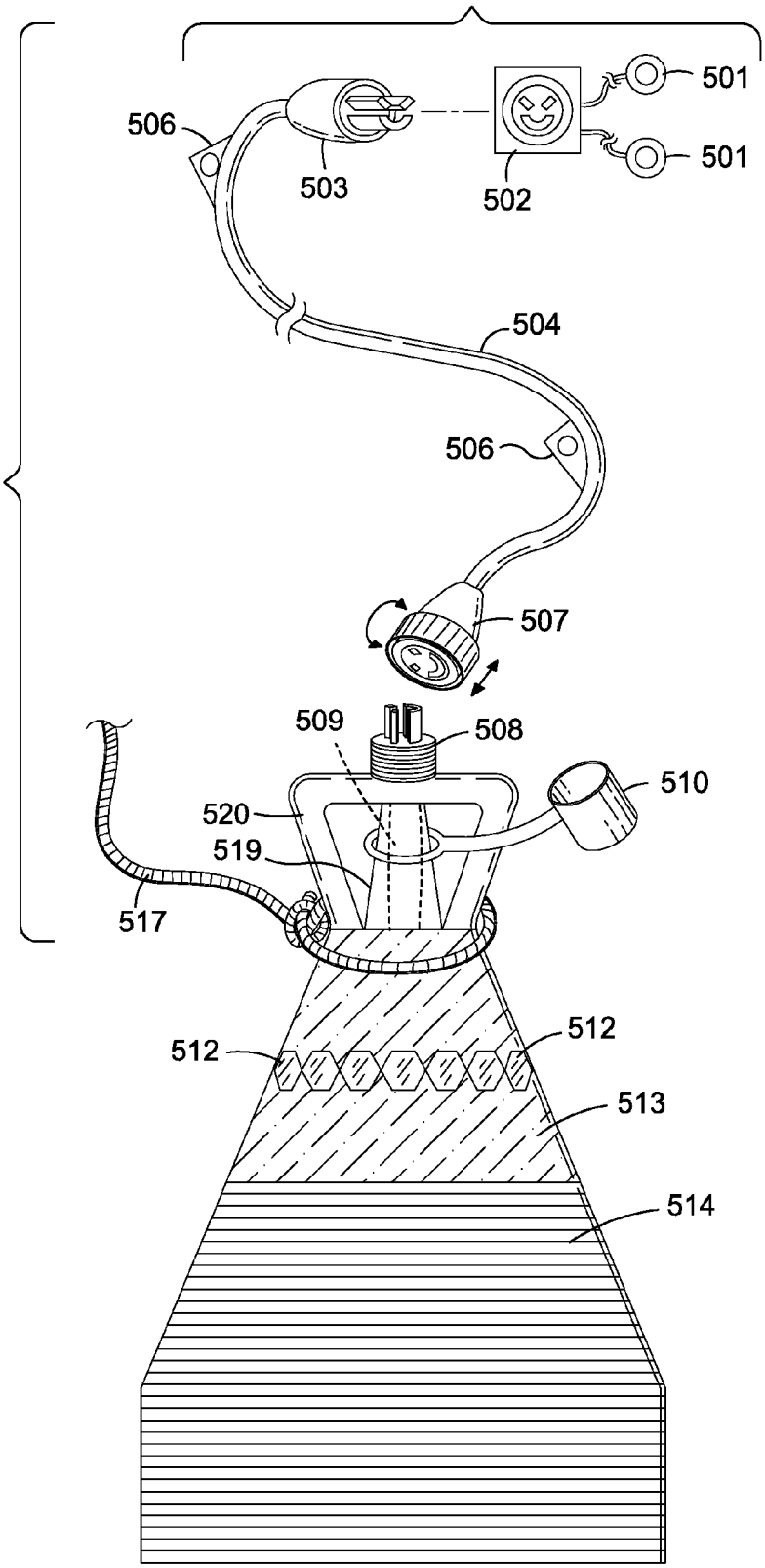
FIG. 5 is an exterior view of an example of the invention, comprising a housing body, external components, accessories, and cord component connections.

An alternative configuration of the plug connector is depicted in FIG. 5. In this example, the second cable segment (an upper portion of which is shown as 509) is wired to a plug connector 508, which is directly joined to the housing component. This figure also depicts a rope 517 structured to loop around the handle 520 or alternatively, around the reinforcement 519. This plug connector 508 is structure to mate, and provide a stable electrical connection, with an electrically conductive cord component (or segment thereof) 504 having a complementary socket connector 507 at the proximal end thereof. The housing component may, in this case, optionally comprise a protective cap, shown as feature 510. The cord component 504 may comprise "holdfast loops" or rivets 506 to tie, for example, to stable dock or deck features, thereby preventing tension being applied by pulling the cord component during use. The distal end of the cord component 504 comprises a male plug connector component, which can be plugged into complementary socket 502 of the bonding system of the structure to be protected. Ring connectors 501 and plug connector 503 are also shown.

As shown in FIG. 5, the housing component exterior may optionally comprise antifouling paint 514, a luminescent coating 513, and/or light reflective prisms 512 or other reflectors.

Various accessories to the apparatus may easily be envisioned, and may, without limitation, include such items such as: a protective canvas cover, a continuity tester, an 'on-off' switch, a circuit breaker switch, a voltmeter gauge, a depth gauge, an incorporated light bulb, a wheeled carry-on container and/or a special storage compartment in the vessel or structure to be protected.

A simple maintenance tool kit may comprise a small wire brush for the anode and hardware, a soft scrubbing pad for the anti-fouling painted surfaces, a simple wrench that fits the nuts, for replacing the anode, and some back up nuts and washers.

Example 3

Figure 6:
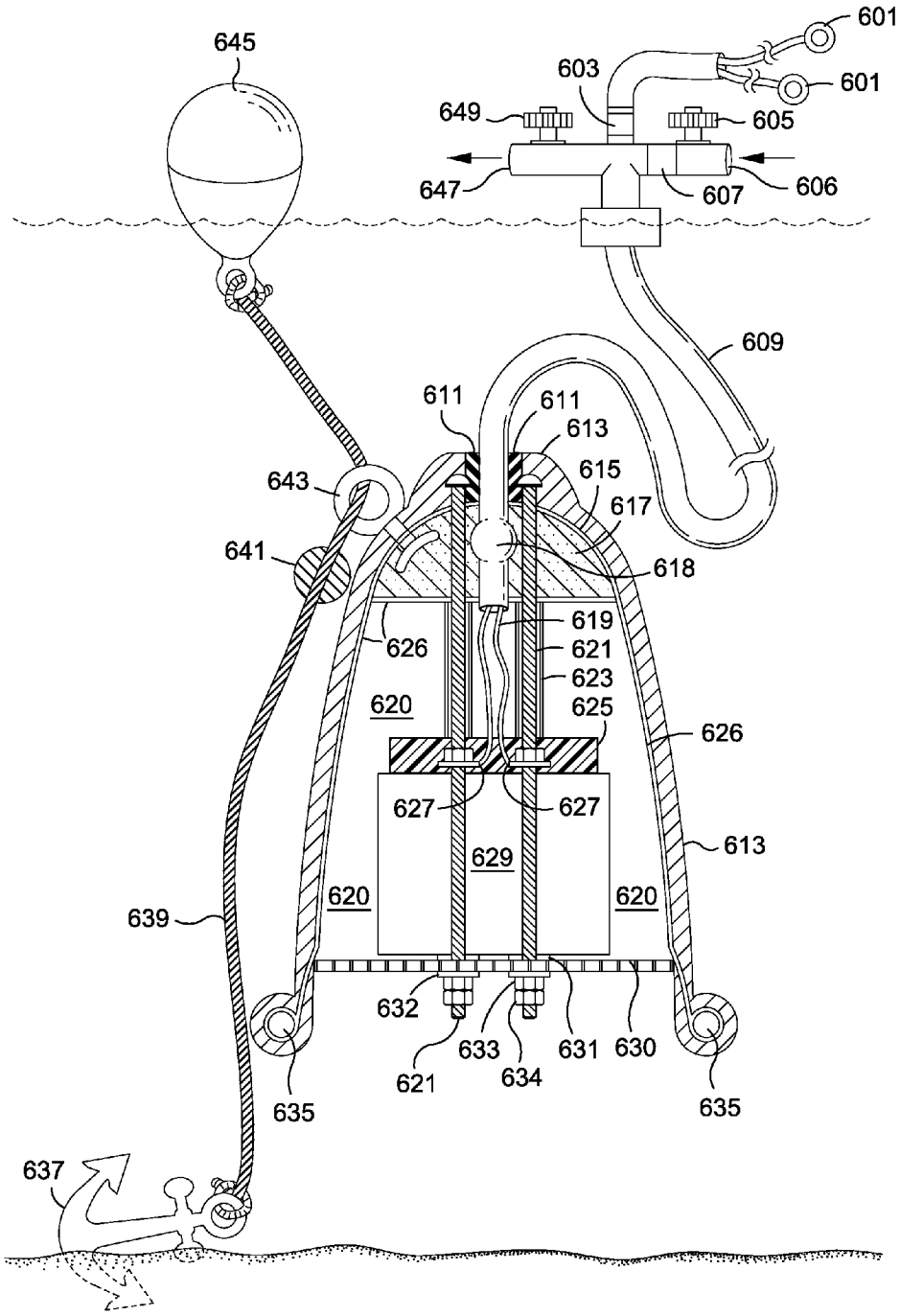
FIG. 6 is a cross-sectional view of a further example of the invention, comprising a dynamic buoyancy housing component structured to float or sink as desired.

FIG. 6 depicts other examples of the invention. In these examples, which may be termed a "dynamic buoyancy" embodiment, the housing component of the invention may be structured to float or sink under the control of an operator.

In these examples, the housing component may comprise, for example, a hydrolysis-resistant, polymeric covering 626 (for example, a thermoplastic polyurethane covering). The polymeric covering may be substantially bell-shaped and encased in a moderate creep, high photolysis tolerance, polymer skin 613 which has an encapsulated foam inner core 617 sealed by a hemispherical enclosure 615, preferably of the same material as the polymeric covering 626 located at the interior top thereof, thereby allowing the apparatus to maintain a vertical posture when totally submerged (i.e., like a jellyfish), without providing enough buoyancy to completely float.

The transition from positive buoyancy to neutral buoyancy, or to negative buoyancy, or back again can be regulated at will, for example, by means of compressed air or gas being injected to, or released from, the airtight internal void space 620 of the apparatus.

These examples of the housing component, anode component (and topside pump, air/gas delivery, and/or electrical components) may have extra waterproofing features such as gaskets and/or seals 603 on the topside piping and on the foremost top of the apparatus 611 that allow it to withstand prolonged periods of time submerged, as well as a check valve 607 inside the compressed air intake pipe 606 by the air intake valve component 605.

At the top of its body, through a pressure resistant seal 611 the apparatus may be connected to a multipurpose heavy duty hose 609 that encloses or comprises one or more of: a dual cable component 619 providing electrical conductivity between the anode in the apparatus and the bonding circuit in the vessel or structure to be protected; a high pressure resistant hose component 609 for pressured air and/or other fluid to be injected through a gas or pair intake pipe 606 to provide buoyancy, for example, when it is desired to bring the apparatus to the surface; an exhaust valve 649 that will allow the compressed air to travel upward from the apparatus through the hose 609 when opened through an air exhaust pipe 647 so that the apparatus will lose buoyancy and sink when desired. Preferably the hose component 609 is structured to prevent it being pulled out of the housing component. One option design for accomplishing this is depicted in FIG. 6 as a thickening around the proximal portion of the hose component 618, wherein the radius of the thickening is greater than the aperture in the foremost top of the apparatus 611.

These examples may also feature means for maintaining the vertical orientation of the housing component and anode component, for example in a current or tide. For example, FIG. 6 shows that the housing component comprises an affixed ring 643 through which a cable 639 can be threaded and attached to an anchor 637 at a bottom end thereof, and a buoy 645 at the surface; this mechanism impedes lateral movement of the apparatus. The cable preferably has a stopper component 641 to prevent the apparatus from laying on the seabed when negatively buoyant.

In certain examples involving a dynamic buoyancy system the Applicant envisions such systems to be used with larger anodes and/or to be utilized in rough weather areas where a submersible apparatus might be a better option, at least temporarily, than the floating version of the apparatus, which would be subject to powerful surf, tides, winds. For example, such systems may prove useful for use in protecting offshore drilling rigs and the like.

The example depicted in FIG. 6 shows contains other optional features, such as a screen 630 at the bottom mouth of the bell to prevent debris or large organisms from entering the void space 620 inside the apparatus. This screen also serves the purpose of adding structural strength to the apparatus. Other features may include PVC or other polymeric pipes 623 acting as conductivity barriers over the portion of the threaded rods 621 exposed to the electrolyte. Additionally, the housing component may comprise a thicker polymer backing plate 625 maintaining the electrical connections 627 between the wires 619 and the threaded rods 621 fully enclosed to provide extra strength and also to prevent a short circuit and ensure the entire electron flow will travel to the sacrificial anode 629. FIG. 4 shows washers 632 and double nuts 633 and 634 for securing the anode component 629 to the housing component. Furthermore, when a screen 630 is present, one or more washer 631 may be placed on the rods between the screen 630 and the anode 629 to create a gap permitting the electrolytic fluid to contact the portion of the anode otherwise covered by the screen. Also, at the lower portion of the apparatus, there may be one or more ring features 635 to facilitate maneuvering the housing component for inspection and maintenance purposes.

In view of the present disclosure, a person of ordinary skill in the art will easily envision additional examples of, or variations to these examples of the invention. For example, and without limitation, when a marine structure to be protected from electrochemical corrosion is large or has a significant amount of immersed or submerged corrosion susceptible areas (e.g., a bridge component, pier component, an offshore structure, such as a oil drilling platform component, and the like), the apparatus of the present invention may comprise more than one anode component. In such examples, the housing component may simply be scaled up in size, or may be redesigned to comprise, for example, "pods" wherein each of the anode components is contained within a separate portion of the housing component.

Example 4

Figure 7A:
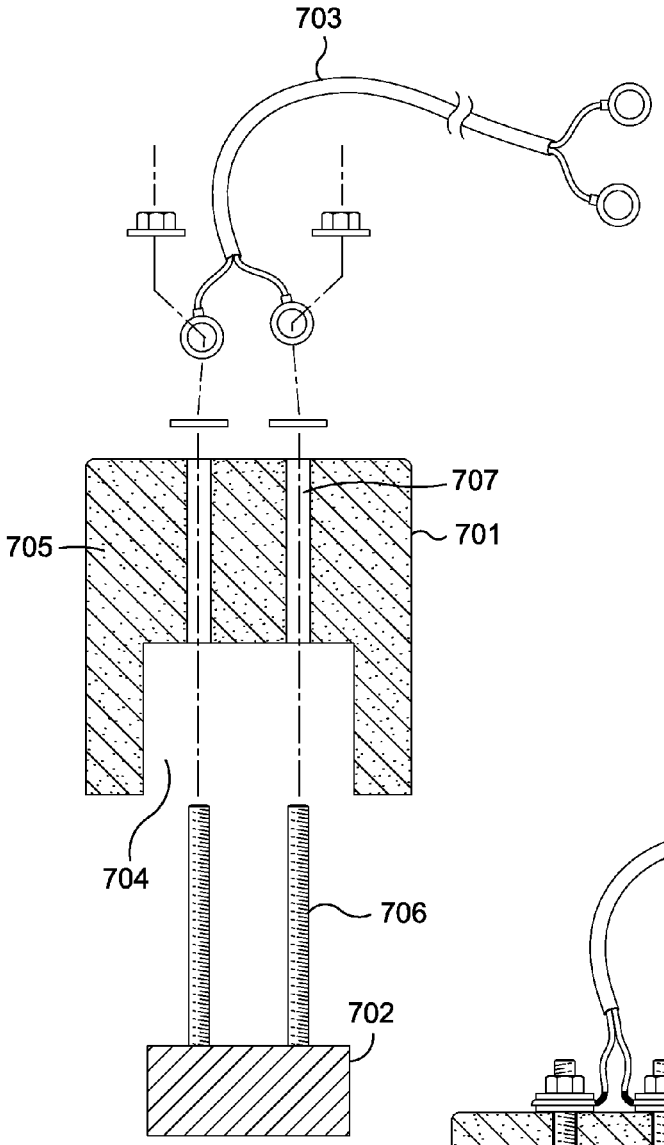
FIG. 7A is an exploded cross-sectional view of another example of the invention.
Figure 7B:
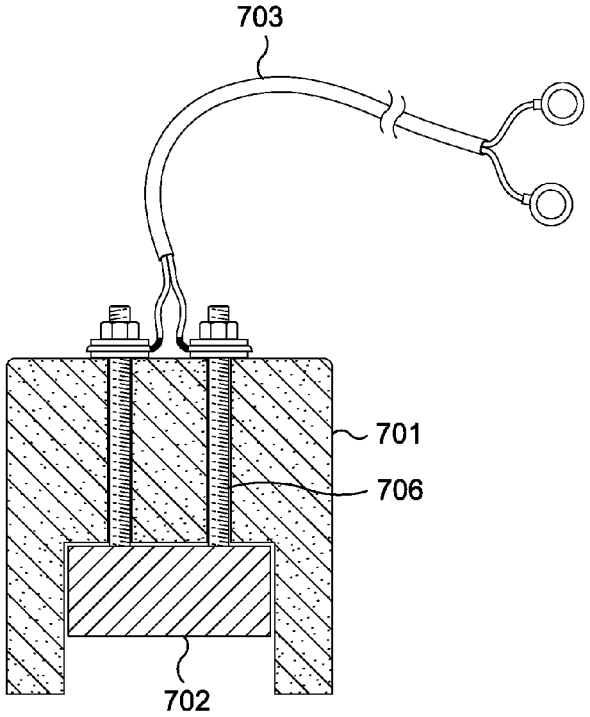
FIG. 7B shows an assembled cross-sectional view of the example of FIG. 7A.

In other examples of the apparatus, systems and methods of present invention, a low-cost, basic (even possibly disposable) version of the apparatus may be desired. FIG. 7A and FIG. 7B are drawn to such a basic version of an anti-corrosion system, in which the apparatus could even be disposed of after a single anode's life cycle.

The housing component 701 may be made of a single piece of an inexpensive material, such as a polymer or plastic, that resists dissolution or deterioration when in direct and prolonged contact with water, and exposed to light and solar radiation for periods of time of one to six months or more. A wide range of inexpensive plastics, rubbers, and even woods may be used. However, expanded closed cell polystyrene foam may be a preferred choice, being inexpensive, easily carvable, impact resistant and buoyant.

The a housing component 701 has a receptacle cavity 704 carved into the foam 705 to provide an inlet space for an anode component 702 to be attached at the bottom of the housing component so that it maintains direct contact with the electrolytic fluid but cannot directly make impact against any flat surface. Preferably the receptacle cavity is made at least slightly deeper than the anode component to prevent making direct contact with underlying surfaces.

In some of these examples, an anode component 702 may be specially manufactured with two permanently embedded conducting rods 706. During assembly the two rods protrude through two elongated cylindrical shaped canals 707 in the housing component. These rods then exit the housing through the top, where they may be connected to one end of an electrically conductive cord component 703. The cord component then connects at the opposite end to the bonding circuit of the structure to be protected; for example, a vessel.

Other examples of this aspect of the invention may be built in even a simpler fashion; for example, using embedded copper wires in the anode as opposed to the embedded rods before mentioned.

The various descriptions of the invention provided herein illustrate presently preferred examples of the invention; however, it will be understood that the invention is not limited to the examples provided, or to the specific configurations, shapes, and relation of elements unless the claims specifically indicate otherwise. Based upon the present disclosure a person of ordinary skill in the art will immediately conceive of other alternatives to the specific examples given, such that the present disclosure will be understood to provide a full written description of each of such alternatives as if each had been specifically described.

What is claimed is:

1. An apparatus for inhibiting galvanic corrosion comprising:

a) a housing component structured to retain an upright posture when immersed in an electrolytic medium, wherein said housing component comprises a bottom receptacle chamber shaped to retain an anode component while exposing said anode to said electrolytic medium, b) an anode component less noble than a metal to be protected from galvanic corrosion, secured to said housing component; and c) an electrically conductive cord component at least partly forming a stable electrical link between the anode component and the metal to be protected, said metal to be protected being in contact with said electrolytic medium;

wherein said electrically conductive cord component is stably mechanically and electrically affixed to said housing component and structured to directly or indirectly make a stable mechanical and electric connection with said metal to be protected;

wherein said anode component is stably affixed to said housing component in a manner whereby said electrically conductive cord component is in electrically conductive contact with said anode, wherein said anode component remains in contact with said electrolytic medium when affixed to said housing component and placed therein, and wherein said anode component comprises a material selected from the group consisting of zinc, magnesium, and aluminum.

2. The apparatus of claim 1 wherein said housing component comprises a positively buoyant material.

3. The apparatus of claim 1 wherein said housing component is structured to be inflated with a gas.

4. The apparatus of claim 2 wherein the shape of said housing component comprises a frustum of a cone.

5. The apparatus of claim 2 wherein said housing component comprises a shape like an elongated or non-elongated doughnut, said housing component at least partly surrounding the anode.

6. The apparatus of claim 1 wherein said housing component comprises a waterproof barrier substantially preventing contact of the interior components of said apparatus with said electrolytic medium.

7. The apparatus of claim 1 wherein said anode component is substantially disc-shaped and comprises at least one hole, and said bottom receptacle chamber comprises at least one threaded rod positioned to fit, and be inserted through, said hole and bolted to said anode; said threaded rod being in direct or indirect electrical contact with both said electrically conductive cord component and said anode component.

8. The apparatus of claim 7 wherein said electrically conductive cord component has a first connector at a distal end structured to selectively and securely mate with a second connector in direct or indirect electrical contact with said second metal.

9. The apparatus of claim 8 wherein one of said first connector and second connector comprises a male plug component, and the other connector comprises a female socket component.

10. The apparatus of claim 9 wherein said electrolytic medium comprises liquid water.

11. The apparatus of claim 10 wherein said metal is comprised in a floating vessel.

12. The apparatus of claim 1 wherein comprising an outer surface treated with an antifouling composition.

13. The apparatus of claim 1 wherein comprising an outer surface treated with a luminescent coating.

14. An apparatus comprising a sacrificial anode component secured in a housing component comprising a buoyant material, said housing component comprising a bottom receptacle chamber shaped to retain an anode component while exposing said anode to said electrolytic medium, wherein said anode component is directly or indirectly conductively secured to an electrically conductive cord component at or near a proximal end thereof, said cord component structured to directly or indirectly make a stable mechanical and electrical connection with a metal to be protected at or near a distal end, said anode component being less noble than said metal to be protected, and wherein said anode component comprises a material selected from the group consisting of zinc, magnesium, and aluminum.

15. The apparatus of claim 14 wherein said housing component comprises a cushioning component to reduce the risk that said anode component will damage an object comprising the metal to be protected.

16. The apparatus of claim 15 wherein said anode component is structured to be removably affixed to and retained by a housing component; wherein, when said housing component is placed in an electrolytic medium, said anode component is in contact with said electrolytic medium.

17. The apparatus of claim 14 wherein the distal end of said electrically conductive cord component comprises a first connector component having a connector feature selected from the group consisting of a plug and a socket, and wherein the object comprises a second connector component having a connector feature selected from the group consisting of a plug and a socket.

18. The apparatus of claim 17 wherein said first connector component and said second connector component comprise a common connector feature.

19. The apparatus of claim 17 wherein said first connector component and said second connector component comprise different connector features.

20. The apparatus of claim 14 wherein said housing component is structured to retain an upright posture when immersed in an electrolytic medium.

21. An apparatus for connecting a sacrificial anode to a structure comprising a metal to be protected from galvanic corrosion, said apparatus comprising:

a) a sacrificial anode component structured to be affixed to and retained by a housing component, said housing component comprising a bottom receptacle chamber shaped to retain an anode component while exposing said anode to said electrolytic medium; wherein, when said housing component is placed in an electrolytic medium, said sacrificial anode is in contact with said electrolytic medium; and b) said housing component having a buoyancy in said electrolytic medium, and structured to provide an electrical connection between said sacrificial anode and said metal to be protected through an electrically conductive cord component electrically linking said anode with said metal;

said electrically conductive cord component having a distal end structured to directly or indirectly form a stable, electrically competent connection with the metal to be protected, and said anode component is less noble than said metal to be protected, and wherein said anode component comprises a material selected from the group consisting of zinc, magnesium, and aluminum.

22. The apparatus of claim 21 wherein said housing component comprises a cushioning material that will reduce the risk that said anode will damage the structure comprising the metal to be protected.

23. The apparatus of claim 22 wherein the housing component sufficiently envelops said anode to prevent the anode from substantially contacting the structure comprising said metal to be protected.

24. The apparatus of claim 21 wherein the distal end of said electrically conductive cord component comprises a first connector component having a connector feature selected from the group consisting of a plug and a socket, and wherein the structure comprises a second connector component having a connector feature selected from the group consisting of a plug and a socket.

25. The apparatus of claim 24 wherein said first connector component and said second connector component comprise the same connector feature.

26. The apparatus of claim 24 wherein said first connector component and said second connector component comprise different connector features.

27. The apparatus of claim 24 wherein said structure comprising a metal to be protected is a floating vessel and said metal to be protected is electrically connected to said second connector feature.

28. The apparatus of claim 24 wherein the structure comprising a metal to be protected is selected from the group consisting of a vessel, a drain component, a petroleum drilling platform component, a bridge component, a pier component, and said metal to be protected is electrically connected to said second connector feature.

29. The apparatus of claim 21 wherein said housing component is positively buoyant.

* * * * *